United States Patent [19]

Yoshikawa

[11] Patent Number: 4,883,181

[45] Date of Patent: Nov. 28, 1989

[54] FOREIGN SUBSTANCE DISPOSING DEVICE FOR MONEY RECEIVING AND DISBURSING MACHINE

[75] Inventor: Eiichi Yoshikawa, Hasuda, Japan

[73] Assignee: Laurel Bank Machines Co. Ltd., Tokyo, Japan

[21] Appl. No.: 269,648

[22] Filed: Nov. 10, 1988

[30] Foreign Application Priority Data

Nov. 12, 1987 [JP] Japan ..... 62-285736

[51] Int. Cl.[4] ..... B07C 5/00

[52] U.S. Cl. ..... 209/534; 209/601; 209/604; 271/263

[58] Field of Search ..... 209/435, 601, 600, 603, 209/604; 271/263; 33/501.01, 501.02, 501.03

[56] References Cited

U.S. PATENT DOCUMENTS

| | | | |
|---|---|---|---|
| 3,076,548 | 2/1963 | Branda et al. | 209/534 |
| 3,712,468 | 1/1973 | Wenner et al. | 209/601 X |
| 3,930,582 | 1/1976 | Gartner et al. | 209/534 |
| 4,068,385 | 1/1978 | Mitzel | 209/534 X |
| 4,527,793 | 7/1985 | Bottcher et al. | 271/263 |
| 4,664,369 | 5/1987 | Graef et al. | 209/604 X |

FOREIGN PATENT DOCUMENTS

| | | | |
|---|---|---|---|
| 12695 | 2/1978 | Japan | 209/534 |
| 62-125489 | 6/1987 | Japan . | |

*Primary Examiner*—Donald T. Hajec

*Attorney, Agent, or Firm*—Fleit, Jacobson, Cohn, Price, Holman & Stern

[57] ABSTRACT

A foreign substance disposing device is disclosed for a money receiving and disbursing machine. The machine comprises a bill receiving section for receiving a stack of bills to be processed in. The machine, pick out rollers for picking out the bills one by one from the stack transfer rollers for transferring the stack of bills from the bill receiving section to the pick out rollers, and transfer driver for driving the transfer rollers a detecting roller is swingably provided between the bill receiving means and the pick out rollers to produce a swingable movement in response to an undulation of the surface of the stack of bills as the bills are transferred. A potentiometer is provided for producing a signal in response to the swingable movement of the detecting roller, and a control device is provided for judging whether or not the bills received in the machine are accompanied by a foreign substance based on the signal from the potentiometer and for controlling the transfer driver to return the bills to the bill receiving section when a foreign substance is detected as a result of the judgment.

7 Claims, 7 Drawing Sheets

FOREIGN SUBSTANCE DISPOSING DEVICE FOR MONEY RECEIVING AND DISBURSING MACHINE

BACKGROUND OF THE INVENTION

1. Field of the invention

The present invention relates to a foreign substance disposing device for a money receiving and disbursing machine, particularly to a device for detecting foreign substances or undesirable things introduced into a money receiving and disbursing machine together with bills to be received and disbursed and for removing the foreign substances from the machine.

2. Description of the prior art

In the case where a foreign substance undesirably accompanies bills which are introduced into a money receiving and disbursing machine for properly being processed, the foreign substance may cause a trouble in an operation of the machine as a result that the foreign substance plugs a bill transmitting path to impede a conveyance of the bill and/or to damage a mechanism of the bill transmitting path.

In view of the above, there have been proposed various systems for disposing of the foreign substance, that is, for detecting such foreign substance accompanying the bills to be processed in the machine and for removing it from the machine.

Japanese patent public disclosure No. 62-125489, laid open to the public on June 6, 1987, discloses a foreign substance disposing device having a pair of rods provided at a bottom portion of a bill receiving opening and extending in a direction crossing bills introduced into a money machine. In this device, the bills being introduced into the money machine is carried by the pair of rods while a foreign substance accompanying the bills introduced into the machine falls by gravity between the rods to be separated from the bills and to be removed from the machine. According to the device disclosed in the above Japanese patent public disclosure, most of the foreign substances accompanying the bills can be removed by making use of the force of nature acting on the foreign substances introduced into the machine.

It should however be noted that the device disclosed in the above Japanese application cannot separate a foreign substance from the bills and thus cannot remove the foreign substance from the machine in such a case where the foreign substance adheres to the bills, for instance, where the foreign substance is of a clip which usually holds the bill and sticks to the bill.

As a result, when a plurality of the bills bundled by a clip are introduced into the machine, the bundled plural bills will be picked out from a feed roller concurrently resulting in a plug of the roller and in turn in some cases, a shut down of the machine. In addition, such clip stick to the bills is tend to damage the feed roller or other mechanisms for conveying the bills if the clip is of a metal.

SUMMARY OF THE INVENTION

It is therefore an object of the present invention to provide a foreign substance disposing device for a money receiving and disbursing machine which can dispose of foreign substances undesirably accompanying the bills effectively.

It is another object of the present invention to provide a foreign substance disposing device for a money receiving and disbursing machine which can detect and separate foreign substances even where the foreign substances adhere to the bills without failure.

The above and other object of the present invention can be accomplished by a foreign substance disposing device for a money receiving and disbursing machine comprising bill receiving section for receiving bills to be processed in said machine, pick out means for picking out the bills one by one, transfer means for transferring the bills from said bill receiving section to said pick out means, transfer drive means for driving said transfer means, detecting roller means swingably provided between said bill receiving means for being brought into contact with a surface of the bills being transferred to said pick out means to produce a swingable movement in response to an undulation of the surface of the bills as the bills are transferred, potentiometer means for producing a signal in response to the swingable movement of the detecting roller means, control means for judging whether or not the bills received in said the machine are accompanied by a foreign substance based on said signal from the potentiometer means and for controlling said transfer drive means to return the bills to the bill receiving section when a foreign substance is detected as a result of said judgment.

The present invention is provided based on a fact that thickness of the bills will be increased when the bills are accompanied by a foreign substance such as clip. The swingable movement of the detecting roller means is increased when the bills accompanying the foreign substance pass through the detecting roller means. The signal from the potentiometer changes in accordance with the movement of the detecting roller means so that the foreign substance accompanying the bills can be detected even where the foreign substance is of a non metallic material.

According to the above features of the present invention, the foreign substances introduced into the money receiving and disbursing machine together with the bills are detected so that the foreign substance can be found out easily and quickly without failure and irrespective of the material thereof such as metal, plastic and the like even where the foreign substance adheres to the bill.

The transfer means will stop transferring the bills from the bill receiving section to the pick out means as soon as the foreign substance is detected so that the foreign substance can be easily taken out of the machine. As a result, the money receiving and disbursing machine can be prevented from plugging of the bills and therefore damaging thereof effectively.

In another feature of the invention, the control means is provided with an alarm means so that the control means provides said transfer means with a signal for returning the bills to the bill receiving section and producing an alarm signal when the a foreign substance is detected based on the judgment in the control means.

According to the present invention, the foreign substance is returned at a receiving section whenever it is detected so that the operator can find it quickly and can remove it from the machine easily.

The above and other objects of the present invention will be apparent from the following descriptions of preferred embodiments taking reference with the accompanying drawings.

DESCRIPTION OF THE PREFERRED EMBODIMENTS

Figure 1:
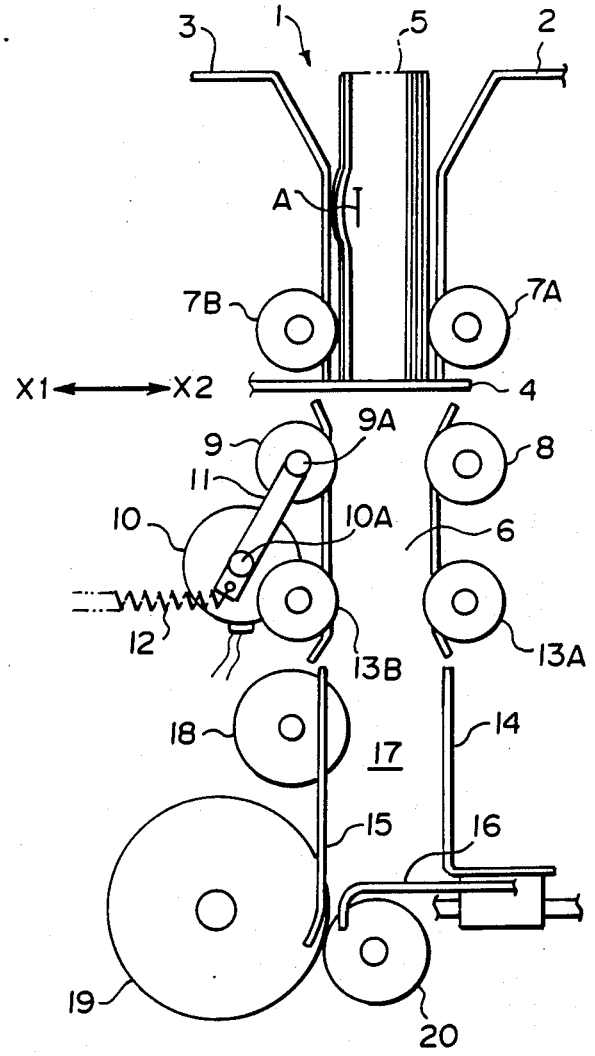
FIG. 1 is a schematic side view of an essential portion of a money receiving and disbursing machine to which the present invention can be applied.
Figure 2A:
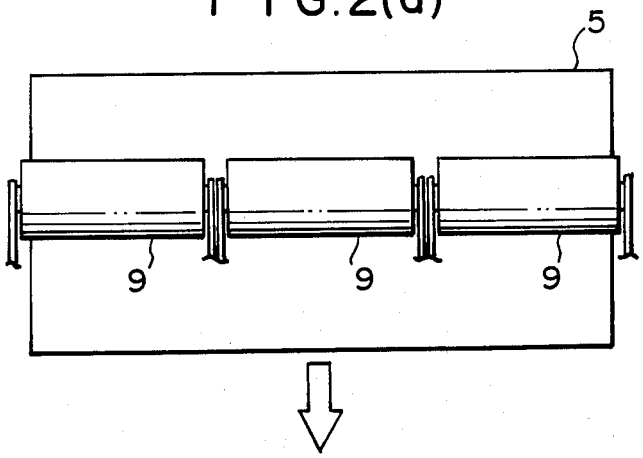
FIGS. 2(*a*), 2(b) are views showing arrangements of detecting rollers.
Figure 2B:
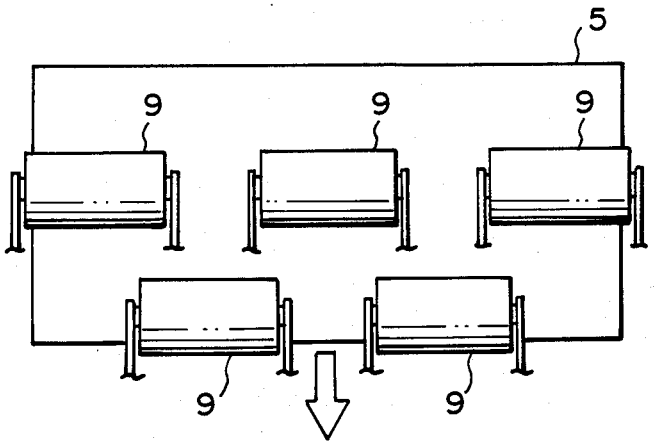
Figure 3:
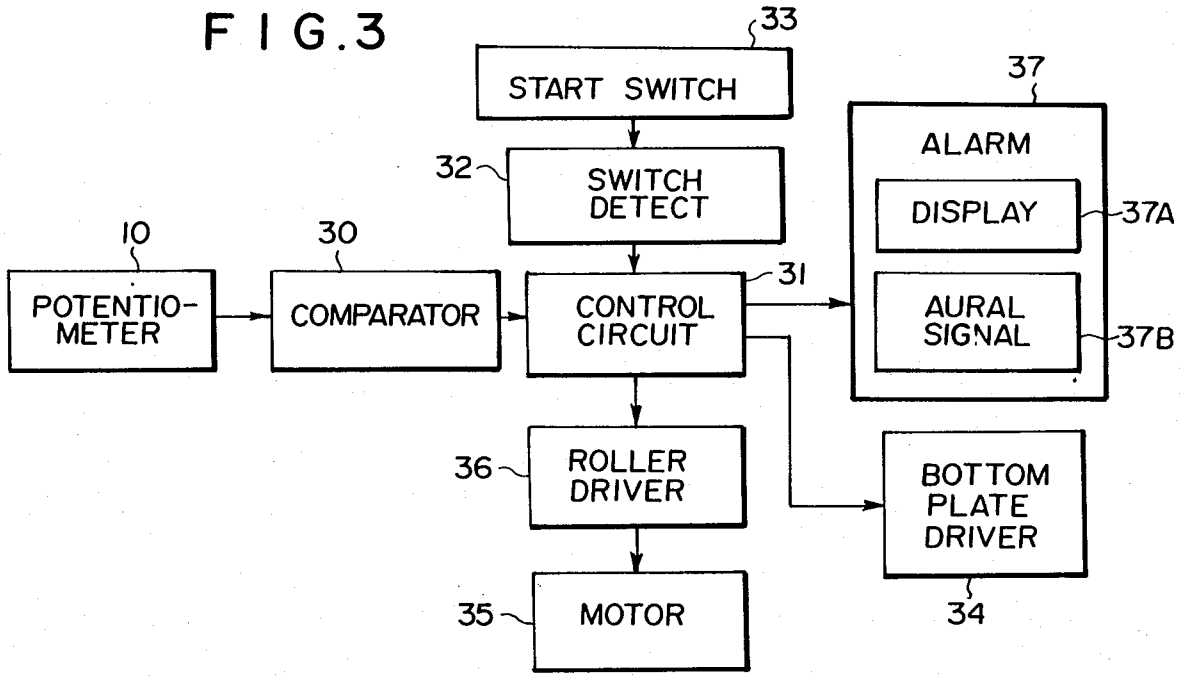
FIG. 3 is a block diagram of the foreign substance disposing device.

Referring to the drawings, specifically to FIGS. 1, 2 and 3, there are shown a schematic view of an essential portion, roller arrangement and control device respectively of a money receiving and disbursing machine to which the present invention can be applied.

In FIG. 1, a bill receiving section 1 of the money receiving and disbursing machine is provided with a stationary clip plate 2, a movable clip plate 3 which can move in a direction X1-X2 and a bottom plate 4. The bills 5 to be processed in the machine are introduced from a transaction window (not shown) to the bill receiving section 1 and are stacked therein. There is provided a pair of first feed rollers 7A and 7B constituted by three rollers respectively and arranged to extend in a direction perpendicular to that of X1-X2 so as to project from openings formed on the movable and stationary clip plates 2 and 3 facing each other. The feed rollers 7B can be moved together with the movable clip plate 3. When the bills 5 are introduced into the bill receiving section 1, the movable clip plate 3 is maintained at a forwardly retracted position to provide a space in which the bills 5 can be introduced properly between the stationary and movable clip plates 2 and 3. There is provided a start switch 33 for initiating money processing. When the switch 33 is turned on, a shutter (not shown) is closed and the movable plate 3 is moved rearwardly so that the bills 5 are clipped by the stationary and movable clip plates 2 and 3 therebetween in the bill receiving section 1. Then the first feed rollers 7A and 7B are actuated to convey the bills 5 therebetween downwardly in a transmitting path 6 after the bottom plate 4 is moved in the direction X1 in FIG. 1 to open the path 6. A reference A shows a clip adhering to the bills 5. There are provided three second rollers 8 arranged in the direction perpendicular to a plane including FIG. 1 and positioned at an upstream portion of the transmitting path 6 and three detecting rollers 9 facing to the second feed rollers 8 and for detecting a foreign substance accompanying the bills 5 in parallel with the second rollers 8. Underneath the detecting rollers 9 is located a potentiometer 10 of which rotation shaft 10A is connected with a rotation shaft 9A of the detecting rollers 9 through a link member 11 so that the detecting rollers 9 can rotate around the rotation shaft 10A. A lower end portion of the link member 11 is joined to a proper base member by means of a spring 12 urging the detecting rollers 9 against the bills 5 being conveyed in the transmitting path 6 so that the link member 11 can be swingably moved in accordance with an undulation of the surface of the bills 5. The potentiometer 10 detects the swingable movement of the link member 11 and produces a voltage signal corresponding to the movement. A distance between the rollers 9 are set as small as possible enough to detect a small foreign substance adhering to the bills 5 as shown in FIG. 2(*a*). The second feed rollers 8 are placed facing to the respective detecting rollers 9 and driven by a motor 35 which also drives the first feed rollers 7A and 7B. The detecting rollers 9, the potentiometer 10 and the link member 11 as well as the movable clip plate 3 and the first feed rollers 7B are mounted on a single movable unit (not shown) which can move in the direction X1-X2 in FIG. 1. When a certain number of bills 5 are placed between the stationary and movable clip plates 2 and 3, the movable unit is actuated to move toward the roller 7A so that the rollers 7A are brought into a tight contact with the surface of the outermost bill of the bills 5 stacked in between the rollers 7A and 7B.

Downstream of the second feed rollers 8 are provided a pair of third feed rollers 13A and 13B facing each other for transmitting the stacked bills 5 examined with regard to adherence of the foreign substance to a storing section 17 including a movable clip plate 14 movable horizontally and a stationary clip plate 15 and a bottom plate 16. Each of the pair of third feed rollers 13A and 13B are constituted by three rollers. The third feed rollers 13A and 13B are driven by the motor 35 as well as the rollers 7B and 8.

There are provided a pair of kick out rollers 18 arranged in a direction perpendicular to the plane including FIG. 1 behind the stationary clip plate 15. The kick out rollers 18 project from the stationary clip plate 15 through an opening (not shown) to be brought into contact with a surface of the foremost bill of the stacked bills 5 which are held between the stationary clip plate 15 and the movable clip plate 14. Underneath the kick out rollers 18, there are provided a pick out roller 19 for taking the foremost bill out of the storing section 17 and a separation roller 20 adapted to be contacted with the pick out roller 19 and to be rotated in a reverse direction against that of the pick out roller 19. The bill is kicked out of the storing section 17 by the kick out rollers 18 downwardly, and picked out through the pick out roller 19 from the storing section 17 while the bill is prevented from a duplicated pick out operation where two or more bills are concurrently picked out of the storing section 17 by virtue of a frictional force exerted by the separation roller 20.

FIG. 3 shows a block diagram of the control device in the foreign substance detecting device in accordance with the illustrated embodiment.

Figure 4:
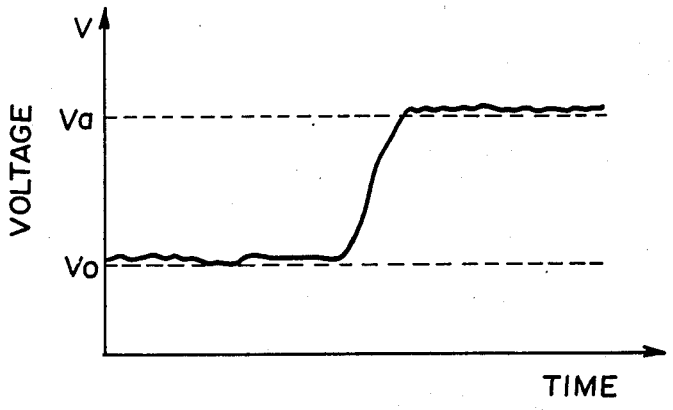
FIG. 4 is a graphical representation showing a change in a voltage signal from a potentiometer.

In FIG. 3, the foreign substance disposing device provided with the control device having a comparator 30 for comparing the voltage signal from the potentiometer 10 with a reference voltage Vr and produce a resulting signal.

Where the stacked bills 5 introduced into the transmitting path 6 and between the detecting rollers 9 and the second feed rollers 8 and where the stacked bills 5 are accompanied by a foreign substance A such as clip, a change in the voltage signal from the potentiometer 10 will change as shown in FIG. 4. In FIG. 4, when the detecting rollers 9 is positioned at a portion of the surface of the stacked bills where there is no foreign substance, the thickness of the stacked bills 5 is substantially constant. Thus, the potentiometer 10 produces a voltage signal V in the vicinity of a base voltage Vo because the link member 11 produces no swingable movement about the rotation shaft 10A as a result of no displacement of the detecting rollers 9.

On the other hand, when the detecting rollers 9 is moved to a portion of the surface of the stacked bills 5 where the foreign substance exists, the thickness of the stacked bills 5 is increased causing a displacement of the detecting rollers 9 namely a swingable movement of the link member 11. As a result, the potentiometer 10 produces a voltage signal Va higher than the base signal Vo in accordance with size of the foreign substance. The reference signal Vr is set between the base and higher signals Vo and Va so that the comparator 30 produces high level signal when the output of the potentiometer 10 exceeds the reference signal Vr. Thus, the high level signal of the comparator 30 shows that the stacked bills 5 introduced into the transmitting path 6 are accompanied by the foreign substance A.

The control device is provided with the start switch 33 for initiating a processing operation for the stacked bills 5 in the bill receiving section 1 and a switching detecting circuit 32 for detecting whether or not the switch 33 is turned on. The control device is further provided with a control circuit 31 for receiving the signals from the comparator 30 and the switching detecting circuit 32 and producing signals to a driver 36 for actuating the motor 35 which drives the first feed rollers 7A, 7B, second feed rollers 8, and third feed rollers 13A, 13B. There is provided a bottom plate driver 34 for receiving a control signal from the control circuit 31 to move the bottom plate 4 horizontally.

The control device is further provided with an alarm device 37 for producing an alarm signal when the foreign substance A is detected through the potentiometer 10 and the comparator 30. The alarm device 37 is provided with a display section 37A for generating a visual signal and an aural signal section 37B for producing an aural signal.

The detecting rollers 9 can be arranged as shown in FIG. 2(*b*) in which three rollers are arranged on a line and the other two rollers are arranged on another line so as to complement spaces formed between the three rollers. In this case, a plurality of the potentiometers 10 may be provided corresponding to the number of the detecting rollers 9 and signals from the potentiometers 10 are introduced to the comparator 30 through one or more OR circuit so that an detection signal of the foreign substance in any potentiometers 10 can be transferred to the comparator 30. Alternatively, a single roller can be arranged across width of the bills 5 as the detecting roller 9.

Figure 5:
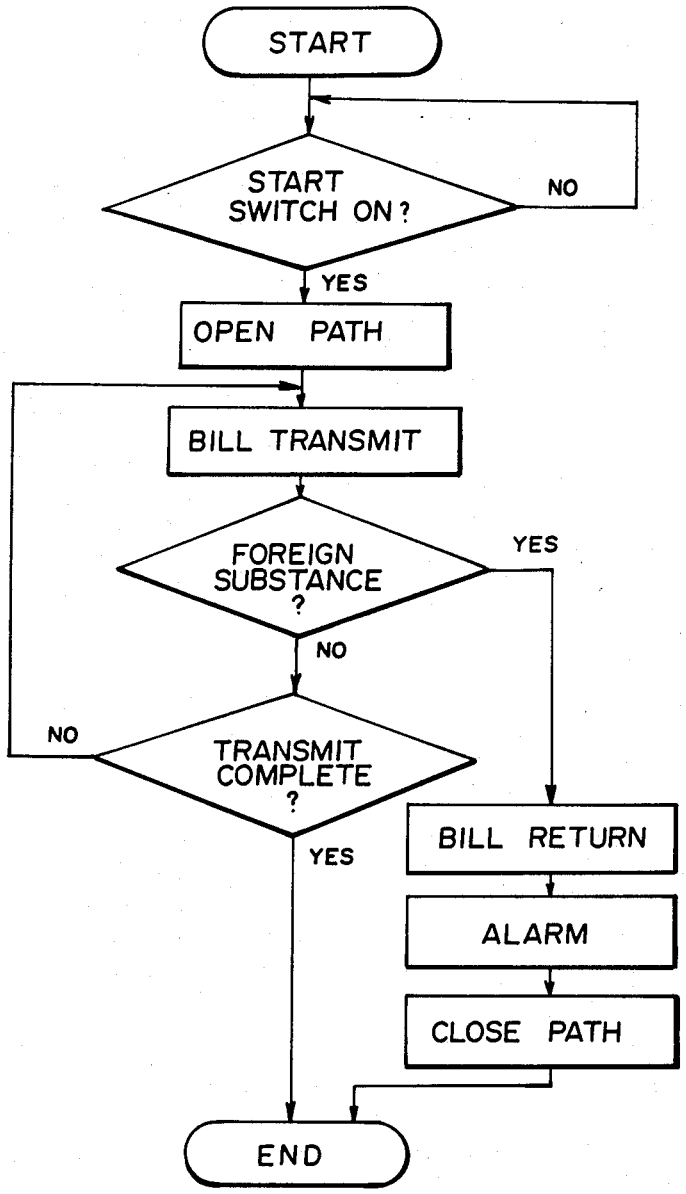
FIG. 5 is a flow chart showing a control in the foreign substance disposing device.

There is shown a flow chart in FIG. 5 disclosing an operation of the device as aforementioned in connection with FIGS. 1, 2 and 3.

Figure 6A:
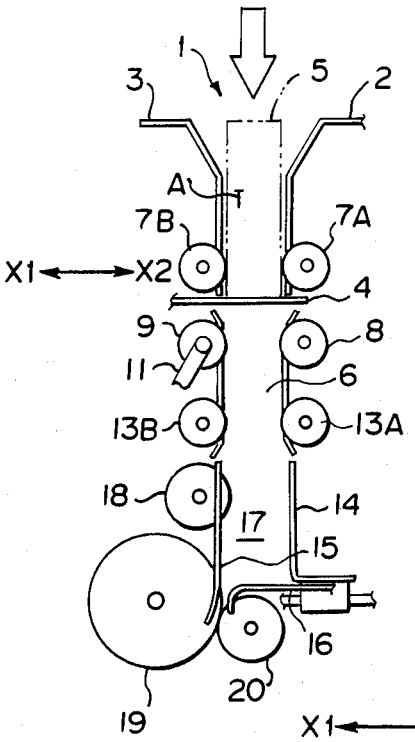
FIGS. 6(*a*), 6(*b*) 6(*c*) are views showing operations in various steps of the foreign substance disposing device.
Figure 6B:
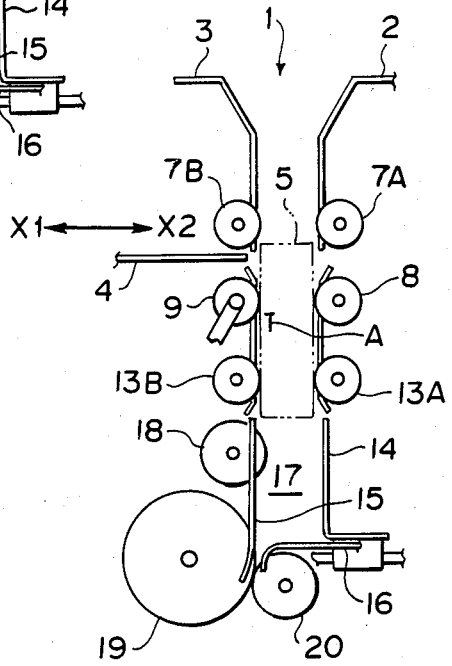
Figure 6C:
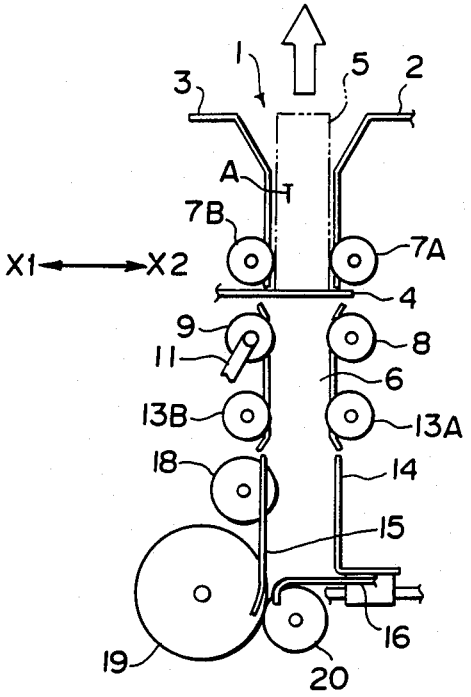

In operation, when the introduction of the bills 5 into the money receiving and disbursing machine is completed, it is judged whether or not the start switch 33 is on through the detecting circuit 32. Where the switch 33 is on, the movable unit is actuated to move rearwardly or toward the stationary clip plate 2 and the first feed rollers 7A together with the movable clip plate 3, first feed rollers 7B so that the stacked bills 5 introduced into the bill receiving section 1 are clipped between the movable and stationary clip plate 2, 3 and the detecting rollers 9 is positioned on the surface of the stacked bills 5 in accordance with the thickness thereof, because the detecting rollers 9 is mounted on the movable unit as well as the movable clip plate 3 and the first feed rollers 7B as shown in FIG. 6(*a*).

When the control circuit 31 receives the signal from the detecting circuit 32 that the switch 33 is turned on, the control circuit 31 produces a signal to the driver 34 so that the bottom plate 4 is moved to open the transmitting path 6. This causes that the stacked bills 5 in the bill receiving section 1 are introduced into the path 6. The stacked bills 5 are introduced into a position between the detecting rollers 9 and the second feed rollers 8 for being examined in thickness as to whether a foreign substance is contained as shown in FIG. 6(*b*).

When the comparator 30 produces a high level signal, the control circuit 31 finds that the stacked bills are accompanied by a foreign substance A. When the foreign substance A is detected based on the signal from the potentiometer 10 and comparator 30, the control circuit 31 produces an alarm signal to the alarm device 37 so that the display section 37A indicates visually and aurally that there is the foreign substance A in the stacked bills 5 introduced in the transmitting path 6 through the display section 37A and aural signal producing section 37B. Concurrently, the control circuit 31 produces a reverse signal to the driver 36 for the motor 35 for rotating the motor 35 reversely so that the first, second and third feed rollers 7A, 7B, 8, 13A and 13B rotate reversely or upwardly in FIG. 6(*c*) to return the stacked bills 5 to the bill receiving section 1. After the stacked bills 5 are returned to the section 1 as shown in FIG. 6(*c*), the motor 35 receives a stop signal from the driver 36 to be stopped. Then the bottom plate 4 is moved to close the path 6 so that the bills 5 returned ca sit on the plate 4. The movable clip plate 3 is retracted.

Thereafter, the foreign substance A detected can be removed from the machine through any suitable means. For instance, the substance A can be removed manually by the operator or a supervisor of the machine from the receiving section 1 before an initiation of the pick out operation of the bills stored in the receiving section 1 through the transaction window after the shutter opens the window.

According to the above embodiment, the foreign substance A can be removed without failure irrespective material thereof such as magnetic material including metal and non-magnetic material including plastics before it is substantially processed so that plugging of the bill in the device and damage of the device can be prevented effectively.

When the stacked bills 5 examined are not accompanied by any foreign substance, the kick out roller 18 and pick out roller 19 is actuated to take the foremost bill on the stacked bills 5 out of the storing section 17 in association with the separation roller 20 adapted to be contacted with the pick out roller 19 after the movable plate 14 is retracted. The bill is kicked out of the storing section 17 by the kick out rollers 18 downwardly, and picked out through the pick out roller 19 from the storing section 17 while the bill is prevented from a duplicated pick out operation where two or more bills are concurrently picked out of the storing section 17 by virtue of a frictional force exerted by the separation roller 20. And the bill is transferred to next section one by one.

In this case, the timing for actuating the kick out roller 18, pick out roller 19 and the separation roller 20, and operation of the movable plate 14 are set based on the timing of the initiation of introduction of the stacked bills 5 to the transmitting path 6 and the speed of the rollers 7A, 7B, 8, 13A and 13B.

It will be apparent from the above description that although various modifications and variations may be made by those skilled in the art without departing from the spirit of the present invention, all the modifications and the like fall into the claims as attached.

I claim:

1. A foreign substance disposing device for a money receiving and disbursing machine comprising a bill receiving section for receiving a stack of bills to be processed in said machine, pick out means for picking out the bills one by one from the stack, transfer means for transferring the stack of bills from said bill receiving section to said pick out means, transfer drive means for driving said transfer means, detecting roller means swingably provided between said bill receiving means and said pick out means, said detecting roller means being brought into contact with a surface of the stack of bills being transferred, and being operable to produce a swingable movement in response to an undulation of the surface of the stack of bills as the stack of bills are transferred, said undulation being caused by a foreign substance potentiometer means for producing a signal in response to the swingable movement of the detecting roller means, control means for judging whether or not the stack of bills received in the machine are accompanied by a foreign substance based on said signal from the potentiometer means and for controlling said transfer drive means to return the stack of bills to the bill receiving section when a foreign substance is detected as a result of said judgment.

2. A foreign substance disposing device in accordance with claim 1 wherein the detecting roller means is connected with the potentiometer means by a link member.

3. A foreign substance disposing device in accordance with claim 1 wherein the detecting roller means is constituted by three spaced rollers arranged on a line perpendicular to a direction in which the bills transferred and by two rollers which are further arranged on another line in parallel to the line on which the three rollers are located so as to complement spaces formed between the three rollers.

4. A foreign substance disposing device in accordance with claim 1 wherein the transfer means is provided with a pair of first feed roller means facing each other, second roller means facing to the detecting roller means and a pair of third roller means facing each other.

5. A foreign substance disposing device in accordance with claim 4 wherein said first, second and third roller means are driven by said transfer driving means commonly provided therefor.

6. A foreign substance disposing device in accordance with claim 5 wherein the bill receiving section is provided with movable clip means and stationary clip means, said first feed roller means and movable clip means movable toward the stationary clip means to clip the bills therebetween.

7. A foreign substance disposing device in accordance with claim 6 wherein the detecting roller means, the potentiometer means and the movable clip plate and one of said pair of first feed roller means are mounted move in a direction normal to the surface of the bills in said bill receiving section.

* * * * *